United States Patent [19]

Fukuoka et al.

[11] Patent Number: 4,976,564

[45] Date of Patent: Dec. 11, 1990

[54] IMPLEMENT FOR APPLYING LIQUID

[75] Inventors: Mitsuhiro Fukuoka; Nobuaki Kobayashi; Fumiyuki Tamiya, all of Osaka, Japan

[73] Assignee: Kabushiki Kaisha Sakura Kurepasu, Osaka, Japan

[21] Appl. No.: 449,274

[22] Filed: Dec. 11, 1989

[30] Foreign Application Priority Data

Dec. 16, 1988 [JP] Japan ..... 63-163720[U]

[51] Int. Cl.[5] ..... B43K 5/08

[52] U.S. Cl. ..... 401/206; 401/176

[58] Field of Search ..... 401/260, 264, 206, 205, 401/176

[56] References Cited

U.S. PATENT DOCUMENTS 3,159,863 12/1964 Mura ..... 401/205 X
3,551,065 12/1970 Molin ..... 401/206
3,640,631 2/1972 Sotir ..... 401/206
4,160,256 7/1979 Dziuk ..... 401/260
4,498,797 2/1985 Peper ..... 401/187

*Primary Examiner*—Richard J. Johnson
*Attorney, Agent, or Firm*—Jordan and Hamburg

[57] ABSTRACT

An implement for applying a liquid comprises a container having an opening at its front end, a front tube attached to the container forward end, a hollow accommodating member having a chamber in its interior and formed with a rearward communication hole and a forward communication hole for holding the chamber in communication with the interior of the container and the interior of the front tube respectively, a liquid feed member accommodated in the chamber and movable axially thereof, a biased end valve disposed inside the front tube providing a liquid retaining portion inside the front tube around the end valve for closing the forward end opening of the front tube, and an applicator having a capillary action extending through the forward end opening of the front tube and secured to the front end of the end valve.

21 Claims, 4 Drawing Sheets

IMPLEMENT FOR APPLYING LIQUID

BACKGROUND OF THE INVENTION AND RELATED ART STATEMENT

The present invention relates to an implement for applying various liquids such as inks, correcting liquids, oil paints, water paints, nail enamels and the like.

Such implements heretofore generally known comprise, for example, an ink stirring ball accommodated in a container having an ink reservoir, and an applicator attached to the forward end of the container and provided with a valve for regulating the flow of ink. When to be used, the implement is shaken in its entirety to agitate the ink within the reservoir for application.

Although such an implement is provided with the regulating valve, an excessive amount of ink is liable to flow toward the applicator to run out dropwise. This problem must be eliminated.

As means for overcoming this problem, Examined Japanese Utility Model Publication SHO 45-22651, for example, discloses a valve provided between a pen core and the interior of a container and biased by a spring so as to usually block a channel between the pen core and the interior of the container. When the container is shaken immediately before use, a ball accommodated in the container pushes the valve open, feeding ink from the interior of the container to the pen core. With this construction, the pen tip is not supplied with any ink in the usual state but is replenished with the ink in small portions only when the container is shaked to open the valve.

Examined Japanese Utility Model Publication SHO 62-29103 discloses a container provided at its forward end with a subchamber in communication with the interior of the container through a restraining portion. When the pen tip is pressed for use against the portion to which ink is to be applied, thereby pressing the container from outside, the ink is forced out from the container into the subchamber. With this construction, the ink within the container is temporarily held in the subchamber instead of flowing out directly from a forward end opening of the container. This precludes the ink from flowing out in a large quantity instantaneously when the valve is opened.

Examined Japanese Utility Model Publication SHO 61-14472 further discloses an implement which comprises a small chamber positioned at the forward end thereof and accommodating an applicator, a container in communication with the chamber through an opening, and a ball for closing the communication opening during use. When the user shakes the implement in its entirety up and down, the ball moves to agitate a liquid in the container, permitting the liquid to flow into the small chamber. The ball closes the communication opening during use to thereby restrict the amount of liquid flowing out from the forward open end of the container.

Examined Japanese Utility Model Publication SHO 45-24976 further discloses a construction wherein a ball is provided between a pen core and a container and biased rearward against a valve seat by a spring to usually hold the pen out of communication with the interior of the container by the contact of the ball with the seat. The container is shaken immediately before use to move the ball and open the valve, whereby ink is fed from the container to the pen core.

Nevertheless these conventional implements have the following problems to be obviated.

With the implements disclosed in the above publications SHO 45-22651 and SHO 45-24976, the pen tip is held out of communication with the interior of the container by the valve in the usual state, so that when the implement is left unused for a long period of time, the ink on the pen is prone to increase in viscosity and will not run out smoothly.

In the case of the implement disclosed in the publication SHO 62-29103, the amount of ink to be forced into the subchamber varies with the pressure applied to the container. This greatly varies the quantity of ink to be applied and makes it difficult to apply the ink uniformly. Moreover, it is difficult to press the container by pressing the pen tip against the contemplated portion during application. Another problem therefore remains in that the implement is not easy to use.

The implement disclosed in the publication SHO 61-14472 is adapted to regulate the flow of liquid from the main liquid chamber to the small chamber by the ball but still has the likelihood that a large quantity of liquid will run out from the small chamber during application.

SUMMARY OF THE INVENTION

An object of the present invention is to provide a liquid applying implement free of the foregoing problems.

In order to fulfill the above object, the invention provides an implement for applying a liquid comprising a container having an opening at its front end and providing the body of the implememt for holding the liquid therein, a front tube attached to the container to close the opening thereof and having an opening at its forward end for holding the interior of the tube in communication with the outside, a hollow accommodating member having a chamber in its interior and formed with a rearward communication hole and a forward communication hole for holding the chamber in communication with the interior of the container and the interior of the front tube respectively, a liquid feed member accommodated in the chamber and movable axially thereof, an end valve disposed inside the front tube movably axially thereof and providing a liquid retaining portion in the form of a small clearance inside the front tube around the end valve for closing the forward end opening of the front tube by contacting the inner surface of forward end portion of the front tube, a member for biasing the end valve toward the forward end of the front tube, and an applicator having a capillary action, extending through the forward end opening of the front tube and secured to the front end of the end valve, the accommodating member being formed at its forward end portion with a tapered guide portion defining an opening decreasing in area toward the forward end, the liquid feed member being movable to thereby force the liquid within the chamber of the accommodating member into the liquid retaining portion through the guide portion.

Before use, the liquid in the container flows through the rearward communication hole of the accommodating member into the chamber but encounters difficulty in flowing into the liquid retaining portion, i.e., the small clearance defined by the inner surface of the front tube and the end valve. In this state, the implement is shaken axially thereof in its entirety before use, thereby reciprocatingly moving the liquid feed member within the chamber axially thereof vigorously to force the liquid in the chamber into the liquid retaining portion through the guide portion and the forward communication hole. The applicator is then pressed against the portion to which the liquid is to be applied, whereby the end valve is pushed rearward against the force of the biasing member to open the forward end opening of the front tube. Consequently, the applicator secured to the end valve is brought into contact with the liquid held in the retaining portion, permitting the liquid to be drawn out by the capillary action of the applicator for application.

The present invention therefore has the advantage that when the applicator is pressed against the contemplated portion, the liquid can be drawn out of the retaining portion approximately at a constant rate, is thereby prevented from running out dropwise and is applicable uniformly. Moreover, the liquid retaining portion is in communication with the chamber in the usual state. This eliminates the likelihood that the liquid, if confined in the retaining portion, will become viscous, failing to flow out smoothly.

The above and other objects, features and advantages of the present invention will become more apparent upon a reading of the following detailed description and the accompanying drawings.

BRIEF DESCRIPTION OF THE DRAWINGS

FIG. 6 (*b*) is a sectional view showing the implement with the cap removed therefrom.

DESCRIPTION OF THE PREFERRED EMBODIMENTS

Figure 1:
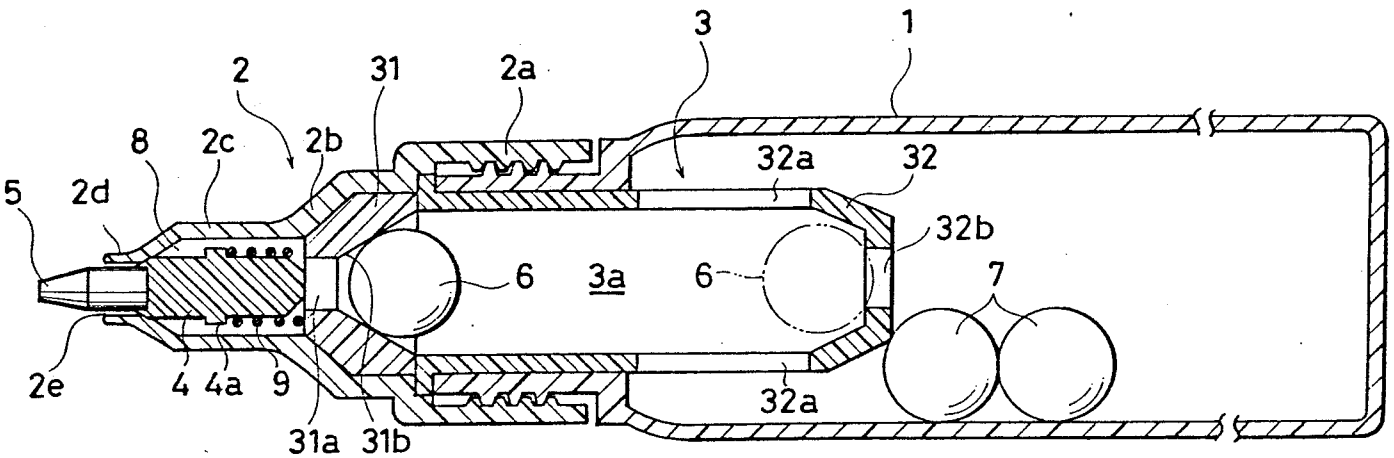
FIG. 1 is a sectional view of a liquid applying implement embodying the invention.

An embodiment of the invention will be described with reference to FIGS. 1 and 2.

The illustrated liquid applying implement comprises a container 1, front tube 2, accommodating member 3, end valve 4, applicator 5 and liquid feed ball (liquid feed member) 6.

The container 1, providing the body of the implement, is in the form of a hollow container having an opening at its front end (left end in FIG. 1) and contains therein the liquid to be applied. The container 1 has further accommodated therein stirring balls 7 when required (as when holding therein a pigment-containing coating composition). The implement is usable for a wide variety of liquids varying from low to relatively high in viscosity, such as inks, correction liquids, paints, oil paints, water paints, nail enamels and the like.

The front tube 2 is so shaped as to have a large-diameter portion 2*a*, tapered portion 2*b*, small-diameter portion 2*c* and forward end portion 2*d* which are arranged in this order from the rear end forward. The large-diameter portion 2*a* is attached to the front end portion of the container 1 to close the opening thereof. The forward end portion 2*d* has an opening 2*e* coaxially therewith.

The accommodating member 3 comprises two segments, i.e., a forward segment (guide portion) 31 and a rearward segment 32.

The forward segment 31 is open at both the front end and rear end thereof and is funnel-shaped (tapered) to define an opening decreasing in area toward the front end. The segment 31 is fitted in the tapered portion 2*b* of the front tube 2. The rearward segment 32 is in the form of a hollow container extending from the open front end of the container 1 rearward and is installed in place with a peripheral edge at its front end held between the front end face of the container 1 and the inner wall of the front tube 2. The forward segment 31 and the rearward segment 32 form a chamber 3*a* for accommodating the feed ball 6.

The accommodating chamber 3*a* communicates with the interior of the front tube 2 and the interior of the container 1 respectively through a forward communication hole 31*a* formed in the forward segment 31 and through rearward communication holes 32*a* formed in the rearward segment 32 and each in the form of a slit extending axially thereof. The rearward holes 32*a* are so sized as to permit the liquid in the container 1 to spontaneously flow into the chamber 3*a*. The feed ball 6 is accommodated in the chamber 3*a* and is movable primarily axially thereof. The rearward communication holes 32*a* are so positioned as to permit the chamber 3*a* to communicate with the interior of the container 1 at the front side of the feed ball 6 as located in its rearmost position (indicated in a phantom line in FIG. 1).

Indicated at 32*b* is a hole formed when the rearward segment 32 is molded. This hole need not always be provided.

The end valve 4 is accommodated in the small-diameter portion 2*c* of the front tube 2 and provides a liquid retaining portion 8 in the form of a small clearance inside the small-diameter portion 2*c* around the valve 4. The valve 4 has a flange 4*a* at an intermediate portion thereof. A compression spring (biasing member) 9 is held between the flange 4*a* and the front end face of the forward segment 31. The end valve 4 is biased forward by the compression spring 9, usually into pressing contact with the inner surface of the front tube 2 (as seen in FIGS. 1 and 2) to thereby close the forward end opening 2*e* of the front tube 2.

The applicator 5 extends through the forward end opening 2*e* and is secured to the front end of the end valve 4. The applicator 5 is useful insofar as it has a capillary action to draw the liquid from the retaining portion 8. Examples of useful applicators are made of the following materials and have the following structures.

(1) Bundle of fibers or brush of nylon, acrylic, polyester or like resin.

(2) Sintered body of fluorocarbon resin, polypropylene, urethane, polyethylene, EVA (ethylene-vinyl acetate copolymer) resin or the like.

(3) Foam of urethane, polypropylene, polyethylene, EVA(ethylene-vinyl acetate copolymer) resin or the like.

(4) Felt of coarse wool, polypropylene or the like.

Applicators made of a hard material such as plastics, glass or metal can also be used when formed, for example, with a plurality of axial liquid grooves in the outer surface thereof to give a capillary action. The applicator 5 is not exposed to the liquid retaining portion 8 when the end valve 4 is pressed forward as illustrated but is brought into contact with the liquid in this portion 8 only when the valve 4 is pushed in rearward.

The operation of the implement will be described next.

In the usual state in which the implement is not in use, the liquid feed ball 6 in the chamber 3*a* is free to move, so that the interior of the container 1 is in communication with the liquid retaining portion 8 through the chamber 3*a* and the forward communication hole 31*a*. However, it is difficult for the liquid in the container 1 and the chamber 3*a* to flow into the retaining portion 8 because the portion 8 is in the form of a small clearance and further because the forward end opening 2*e* is closed with the end valve 4 as stated above.

When the implement 1 in this state is axially shaken in its entirety, the liquid feed ball 6 reciprocatingly moves vigorously within the chamber 3*a*. When the ball 6 is in its rearmost position (indicated in the phantom line in FIG. 1) during this movement, the liquid within the container 1 flows into the chamber 3*a* via the rearward communication holes 32*a*. When moved forward from this position, the ball 6 forces the liquid in the chamber 3*a* into the retaining portion 8. Thus, the reciprocating movement of the feed ball 6 causes the liquid to flow from the container 1 into the retaining portion 8 to thereby replenish the retaining portion 8 with the liquid. Since the forward segment 31 providing the front end portion of the accommodating member 3 serves as a funnel-shaped guide portion as stated above, the liquid in the chamber 3*a* can be smoothly forced into the retaining portion 8.

At this time, the front end of the end valve 4 is pressed against the inner surface of the front tube 2 by the elastic force of the compression spring 9 to thereby close the forward end opening 2*e*. This obviates the likelihood that the liquid will spill out from the end opening 2*e*.

Figure 2:
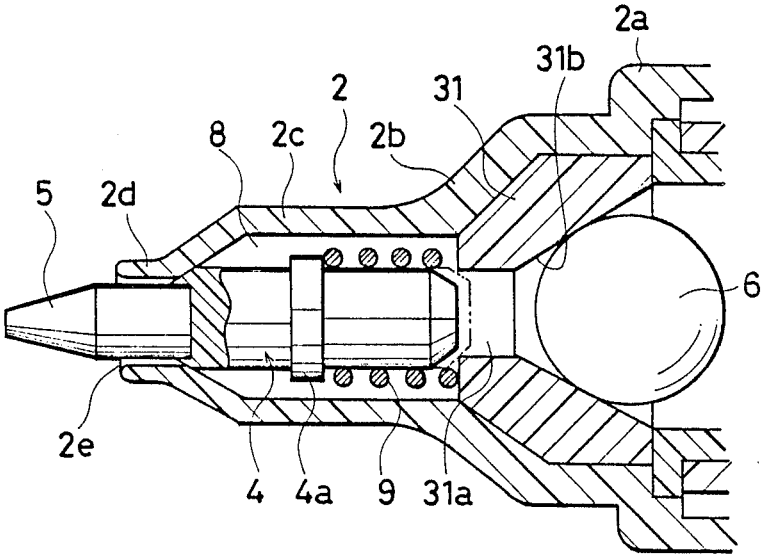
FIG. 2 is a fragmentary view in section showing the implement.

Next, the implement is raised from this state to an upright state with the applicator 5 down, causing the ball 6 to fit into the forward segment 31 as indicated in a solid line in FIG. 1, with the result that the chamber 3*a* is held out of communication with the retaining portion 8 by the contact of the ball 6 with the inner surface of the forward segment 31.

When the applicator 5 is pressed against the portion to which the liquid is to be applied, the applicator 5 and the end valve 4 are pushed in toward the rear end of the implement against the force of the compression spring 9. This brings the applicator 5 into contact with the liquid supplied to the retaining portion 8. Consequently, the liquid is drawn out of the implement by the capillary action of the applicator 5 and made ready for application. When the retaining portion 8 is drained of the liquid, the implement is shaken again for replenishment.

Thus, the present implement is adapted to hold the liquid in the retaining portion 8 in small portions and permit the liquid to be drawn from the portion 8 by the capillary action of the applicator 5. This precludes the liquid from running out dropwise in a large quantity when the applicator 5 is pressed against the contemplated portion. Moreover, the liquid is forced into the liquid retaining portion 8 by the reciprocating movement of the feed ball 6, and the accommodating member 3 has the front end guide portion (forward segment 31 in the present embodiment) for the liquid, so that even if a small clearance serves as the retaining portion 8, with the forward end opening 2*e* closed with the valve 4, the retaining portion 8 can be fully replenished with the liquid merely by shaking the implement in its entirety. Further because the retaining portion 8 is in communication with the chamber 3*a* in the usual state, the liquid in the portion 8 will not become viscous owing to the evaporation of the solvent in the liquid. This obviates the likelihood that the liquid will not flow out smoothly.

The present embodiment is further adapted to hold the liquid retaining portion 8 out of communication with the chamber 3*a* by the contact of the feed ball 6 with the inner surface of the forward segment 31 defining the hole 31*a*. Accordingly, even if the internal temperature of the container 1 rises to result in an increased pressure owing to a change in the ambient temperature or to the temperature of the hand, the change in the pressure will not be transmitted to the retaining portion 8. As a result, the dropwise leakage can be precluded with higher reliability.

The implement of the present invention is not limited to the above embodiment in respect of the shape or construction of its components but can be modified, for example, as will be described below.

Figure 3:
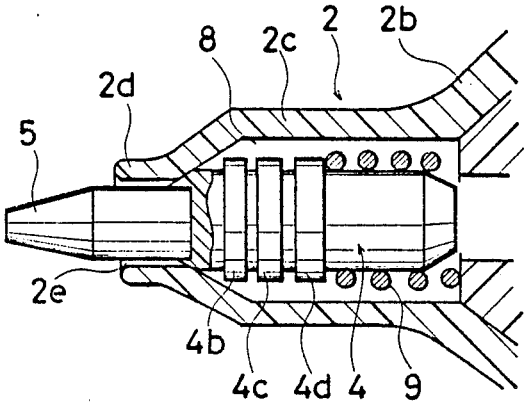
FIG. 3 is a fragmentary view in section showing another implement embodying the invention.

(1) When the end valve 4 is formed with a plurality of flanges 4*b* to 4*d* as shown in FIG. 3 and thereby given an increased surface area, the valve 4 and the inner surface of the front tube 2 have enhanced ability to retain the liquid, with the result that the liquid can be effectively retained in the portion 8 even when having a relatively low viscosity.

Figure 4:
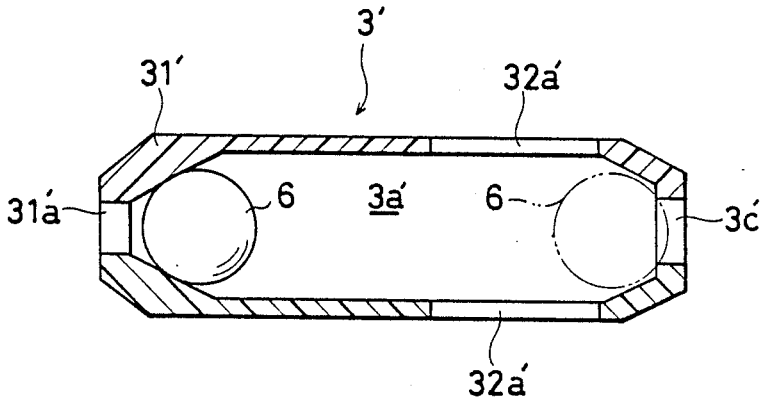
FIGS. 4 and 5 are sectional views showing accommodating members and liquid feed members according to other embodiments.

(2) The accommodating member of the present invention may comprise longitudinally divided segments as indicated at 3' in FIG. 4, or may be in the form of an integral member. For example in the case of the accommodating member 3', the front end and the rear end thereof may be formed respectively with the same forward communication hole 31*a'* and rearward communication holes 32*a'* as in the above embodiment, with a tapered guide portion 31' formed inside the front end thereof. It is then possible to smoothly force the liquid into the retaining portion 8 from the chamber 3*a'*. Indicated at 3*c'* in FIG. 4 is a hole formed when the accommodating member 3' is molded.

Figure 5:
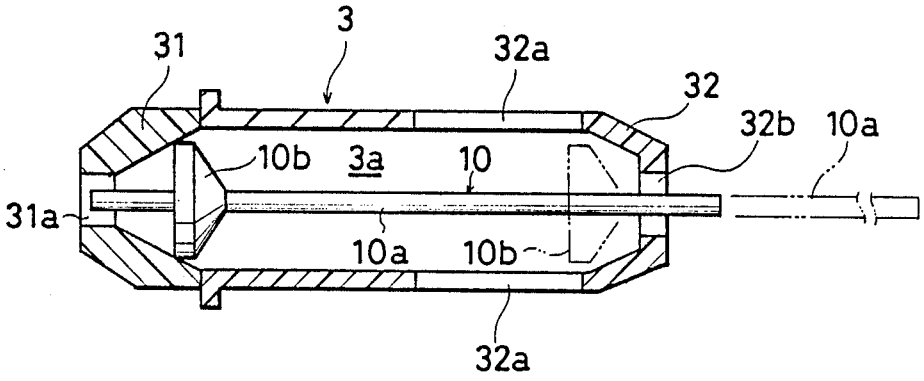

(3) Alternatively, the accommodating member 3 or 3' may be made to axially movably support thereon a liquid feed member 10 comprising a stem 10*a* and a conical feed portion 10*b* utilizing the hole 3*c* or 3*c'* as shown in FIG. 5. In this case, the feed member 10 is restrained from moving forward by the contact of the feed portion 10*b* with the forward segment 31 (guide portion 31').

(4) The term "applying" is used herein not in a narrow sense of the word such as "coating," such that the present implement is widely usable as a writing implement, marker or the like when the applicator 5 is suitably shaped differently.

Figure 6A:
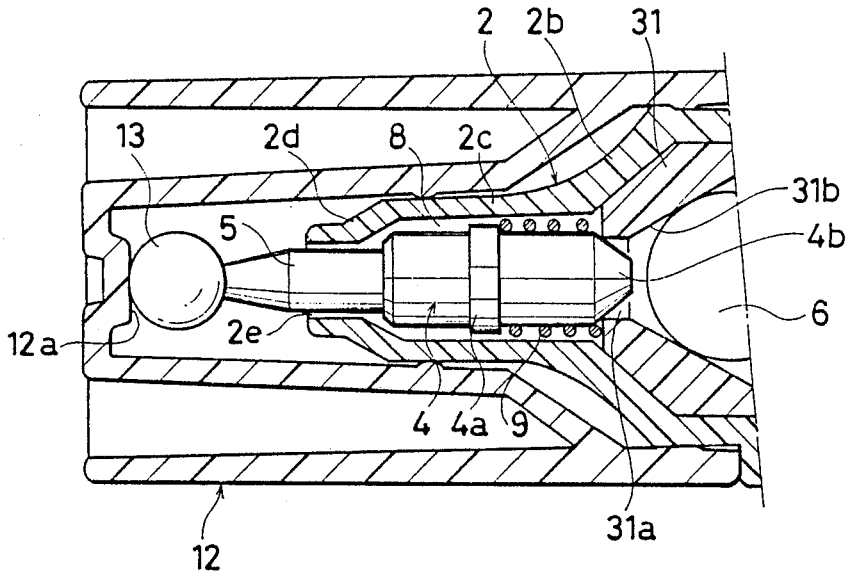
FIG. 6 (*a*) is a sectional view showing a cap as attached to the implement.
Figure 6B:
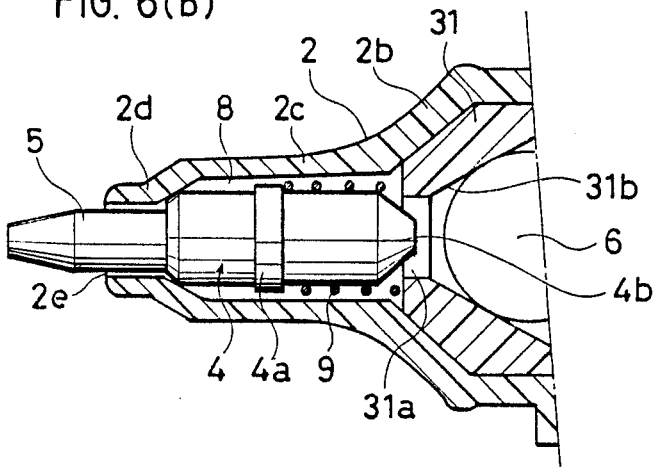

(5) When the implement described above is transported or otherwise handled, it is likely that the valve will be opened by an external force acting on the implement during handling, permitting leakage of the liquid before use. This problem is avoidable by fitting a cap 12 to the implement body with a spherical elastic body 13 interposed between the inner wall 12*a* of top of the cap 12 and the forward end of the applicator 5 in pressing contact therewith to hold the valve 4 pushed in rearward by the elastic body 13 as seen in FIG. 6 (*a*). The elastic body is made of a soft or flexible material not to cause damage to the applicator 5 and having ability to elastically restore itself. Examples of suitable materials are rubbers having high restitution elasticity, such as natural rubber, isoprene rubber, butadiene rubber, chloroprene rubber, urethane rubber and silicone rubber, and foams of polyurethane, polyethylene, ethylene-vinyl acetate copolymer and the like.

While the implement is not in use with the cap 12 attached thereto (the state of FIG. 6 (*a*)), the end valve 4 is restrained from moving forward by the elastic body 13 provided between the top inner wall 12*a* and the applicator 5 in pressing contact therewith. The valve 4 therefore remains immovable, for example, even if shaken during transport. More specifically, the junction of the valve seal portion 4*b* and the inner peripheral edge of the forward segment 31 around the hole 31*a* is sealed off, with no clearance formed therebetween.

When the cap 12 is removed in this state, the end valve 4 is released from the restraint by the elastic body 13, pressed against the inner surface of the forward end portion of the front tube 2 by the force of the compression spring 9 and made movable when subjected to an external force (the state of FIG. 6 (*b*)). Thus, the arrangement described, although simple, completely prevents the leakage of the liquid before use. The implement nevertheless can be made ready for use merely by removing the cap along with the elastic body 13, while there is no likelihood of the applicator becoming lost.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An implement for applying a liquid comprising:

an elongated container having a forward end which is open;

a front member attached to said forward end of said container, said front member having a longitudinal axis and an axially extending front tube having a forward end with an outlet opening;

an elongated accommodating member disposed within said container and extending into said front member, said accommodating member having an interior chamber having a rearward opening communicating with said container and a forward opening communicating with said front member;

a liquid feed member disposed in said interior chamber of said accommodating member, said accommodating member having a longitudinal axis, said feed member being axially movable in said interior chamber;

an end valve axially movable in said front tube between open and closed positions, a narrow retaining passage between said end valve and said front tube, said end valve in said open position allowing liquid to pass from said narrow retaining passage out through said outlet opening of said front tube, said end valve in said closed position closing off said outlet opening of said front tube, biasing means in said front tube for biasing said end valve toward said closed position;

said feed member being axially and reciprocably movable in said interior chamber upon manually shaking of the implement such that liquid in said interior chamber is forced into said narrow retaining passage via said front opening in said accommodating member; and an applicator secured to said end valve and extending through said outlet opening of said front tube such that when said end valve is in said open position, the liquid in said retaining passage is drawn out by capillary action through said outlet opening to said applicator to be applied to a receiving surface.

2. An implement according to claim 1, wherein said accommodating member has a forward tapered guide portion leading to said forward opening, said tapered guide portion decreasing in cross-sectional area as said forward opening is approached.

3. An implement according to claim 1, wherein said accommodating member has seating means juxtaposed to said forward opening, said liquid feed member being seatable on said seating means to preclude flow of liquid from said interior chamber of said accommodating member out through said forward opening.

4. An implement according to claim 3, wherein said seating means has a frusto-conical configuration having a large diameter end and a small diameter end, said small diameter end being disposed closer to said forward opening than said large diameter end.

5. An implement according to claim 1, wherein said interior chamber of said accommodating member has a forward interior end and a rear interior end, said liquid feed member being axially reciprocable in said interior chamber between forward and rear positions, said liquid feed member contacting said forward interior end when in said forward position, said liquid feed member contacting said rear interior end when in said rear position, said rearward opening in said accommodating member providing communication between said container and said interior chamber of said accommodating member when said liquid feed member is in said rear position.

6. An implement according to claim 1, wherein said rearward opening in said accommodating member comprises an axially extending slit.

7. An implement according to claim 6, wherein said accommodating member has a rear end wall, said slit being spaced from said rear end wall.

8. An implement according to claim 2, wherein said accommodating member comprises a front segment and a rear segment, said front segment having said front opening and said tapered guide portion, said rear segment having said rearward opening.

9. An implement according to claim 1, wherein said accommodating member comprises longitudinally divided segments.

10. An implement according to claim 1, wherein said accommodating member is an integrally formed member.

11. An implement according to claim 1, wherein said liquid feed member is a spherical ball.

12. An implement according to claim 1, wherein said liquid feed member comprises a body portion and an elongated stem extending axially from said body portion.

13. An implement according to claim 1, wherein said front member has a large diameter portion axially spaced from a small diameter portion along with a tapered portion between said large diameter portion and said small diameter portion, said large diameter portion being connected to said container.

14. An implement according to claim 1, wherein said end valve comprises a generally cylindrical body having a flange.

15. An implement according to claim 1, wherein said end valve comprises a generally cylindrical body having a plurality of flanges.

16. An implement according to claim 1, wherein said applicator comprises a bundle of fibers.

17. An implement according to claim 1, wherein said applicator comprises a brush.

18. An implement according to claim 1, wherein said applicator comprises a sintered body.

19. An implement according to claim 1, wherein said applicator comprises a foam material.

20. An implement according to claim 1, wherein said applicator comprises a felt material.

21. An implement according to claim 1, wherein said applicator is made of a hard material and is formed in its outer surface with a plurality of liquid grooves extending axially thereof.

* * * * *